US007400123B1

(12) United States Patent
Voogel

(10) Patent No.: US 7,400,123 B1
(45) Date of Patent: Jul. 15, 2008

(54) VOLTAGE REGULATOR WITH VARIABLE DRIVE STRENGTH FOR IMPROVED PHASE MARGIN IN INTEGRATED CIRCUITS

(75) Inventor: Martin L. Voogel, Los Altos, CA (US)

(73) Assignee: Xilinx, Inc., San Jose, CA (US)

( * ) Notice: Subject to any disclaimer, the term of this patent is extended or adjusted under 35 U.S.C. 154(b) by 158 days.

(21) Appl. No.: 11/401,570

(22) Filed: Apr. 11, 2006

(51) Int. Cl.
*G05F 1/40* (2006.01)
*G05F 3/16* (2006.01)

(52) U.S. Cl. ..... 323/280; 323/314; 327/539

(58) Field of Classification Search ..... 323/280, 323/281, 314, 316; 327/539
See application file for complete search history.

(56) References Cited

U.S. PATENT DOCUMENTS 5,072,136 A * 12/1991 Naghshineh ..... 326/126
5,124,631 A * 6/1992 Terashima ..... 323/313
5,861,774 A * 1/1999 Blumenthal ..... 330/2
5,867,013 A * 2/1999 Yu ..... 323/314
5,912,552 A * 6/1999 Tateishi ..... 323/285
6,720,755 B1 * 4/2004 Sharpe-Geisler ..... 323/314
6,946,825 B2 * 9/2005 Tesi ..... 323/313
2002/0125874 A1 * 9/2002 Heinrich ..... 323/313
2003/0038617 A1 * 2/2003 Yaklin ..... 323/304
2003/0151396 A1 * 8/2003 Self et al. ..... 323/312

OTHER PUBLICATIONS

U.S. Appl. No. 10/360,465, filed Feb. 6, 2003, Lesea et al.
U.S. Appl. No. 11/343,555, filed Jan. 31, 2006, Vasudevan.
U.S. Appl. No. 11/343,948, filed Jan. 31, 2006, Voogel et al.

* cited by examiner

*Primary Examiner*—Jessica Han
*Assistant Examiner*—Emily Pham
(74) *Attorney, Agent, or Firm*—Lois D. Cartier; LeRoy D. Maunu

(57) ABSTRACT

A voltage supply circuit having variable drive strength can optionally be used to provide improved phase margin in an integrated circuit. A bandgap circuit drives an operational amplifier, with the second input of the operational amplifier being a regulated voltage node. The operational amplifier drives multiple pull-ups in a pull-up network coupled to the regulated voltage node, of which the different pull-ups can be separately enabled to control the effective channel width of the pull-up network. In some embodiments, a control circuit (e.g., one or two additional operational amplifiers driving a counter) accepts the output of the operational amplifier as an input signal and provides multiple enable signals to the pull-up network.

20 Claims, 8 Drawing Sheets

VOLTAGE REGULATOR WITH VARIABLE DRIVE STRENGTH FOR IMPROVED PHASE MARGIN IN INTEGRATED CIRCUITS

FIELD OF THE INVENTION

The invention relates to integrated circuits. More particularly, the invention relates to voltage regulation in integrated circuits.

BACKGROUND OF THE INVENTION

Programmable logic devices (PLDs) are a well-known type of integrated circuit that can be programmed to perform specified logic functions. One type of PLD, the field programmable gate array (FPGA), typically includes an array of programmable tiles. These programmable tiles can include, for example, input/output blocks (IOBs), configurable logic blocks (CLBs), dedicated random access memory blocks (BRAM), multipliers, digital signal processing blocks (DSPs), processors, clock managers, delay lock loops (DLLs), and so forth.

Each programmable tile typically includes both programmable interconnect and programmable logic. The programmable interconnect typically includes a large number of interconnect lines of varying lengths interconnected by programmable interconnect points (PIPs). The programmable logic implements the logic of a user design using programmable elements that can include, for example, function generators, registers, arithmetic logic, and so forth.

The programmable interconnect and programmable logic are typically programmed by loading a stream of configuration data into internal configuration memory cells that define how the programmable elements are configured. The configuration data can be read from memory (e.g., from an external PROM) or written into the FPGA by an external device. The collective states of the individual memory cells then determine the function of the FPGA.

Another type of PLD is the Complex Programmable Logic Device, or CPLD. A CPLD includes two or more "function blocks" connected together and to input/output (I/O) resources by an interconnect switch matrix. Each function block of the CPLD includes a two-level AND/OR structure similar to those used in Programmable Logic Arrays (PLAs) and Programmable Array Logic (PAL) devices. In CPLDs, configuration data is typically stored on-chip in non-volatile memory. In some CPLDs, configuration data is stored on-chip in non-volatile memory, then downloaded to volatile memory as part of an initial configuration sequence.

For all of these programmable logic devices (PLDs), the functionality of the device is controlled by data bits provided to the device for that purpose. The data bits can be stored in volatile memory (e.g., static memory cells, as in FPGAs and some CPLDs), in non-volatile memory (e.g., FLASH memory, as in some CPLDs), or in any other type of memory cell. PLDs can also be implemented in other ways, e.g., using fuse or antifuse technology. The terms "PLD", "programmable logic device", and "programmable integrated circuit" include but are not limited to these exemplary devices, as well as encompassing devices that are only partially programmable. For example, one type of PLD includes a combination of hard-coded transistor logic and a programmable switch fabric that programmably interconnects the hard-coded transistor logic.

As noted above, advanced FPGAs can include several different types of programmable logic blocks in the array. For example, FIG. 1 illustrates an FPGA architecture 100 that includes a large number of different programmable tiles including multi-gigabit transceivers (MGTs 101), configurable logic blocks (CLBs 102), random access memory blocks (BRAMs 103), input/output blocks (IOBs 104), configuration and clocking logic (CONFIG/CLOCKS 105), digital signal processing blocks (DSPs 106), specialized input/output blocks (I/O 107) (e.g., configuration ports and clock ports), and other programmable logic 108 such as digital clock managers, analog-to-digital converters, system monitoring logic, and so forth. Some FPGAs also include dedicated processor blocks (PROC 110).

In some FPGAs, each programmable tile includes a programmable interconnect element (INT 111) having standardized connections to and from a corresponding interconnect element in each adjacent tile. Therefore, the programmable interconnect elements taken together implement the programmable interconnect structure for the illustrated FPGA. The programmable interconnect element (INT 111) also includes the connections to and from the programmable logic element within the same tile, as shown by the examples included at the top of FIG. 1.

For example, a CLB 102 can include a configurable logic element (CLE 112) that can be programmed to implement user logic plus a single programmable interconnect element (INT 111). A BRAM 103 can include a BRAM logic element (BRL 113) in addition to one or more programmable interconnect elements. Typically, the number of interconnect elements included in a tile depends on the height of the tile. In the pictured embodiment, a BRAM tile has the same height as four CLBs, but other numbers (e.g., five) can also be used. A DSP tile 106 can include a DSP logic element (DSPL 114) in addition to an appropriate number of programmable interconnect elements. An IOB 104 can include, for example, two instances of an input/output logic element (IOL 115) in addition to one instance of the programmable interconnect element (INT 111). As will be clear to those of skill in the art, the actual I/O pads connected, for example, to the I/O logic element 115 are manufactured using metal layered above the various illustrated logic blocks, and typically are not confined to the area of the input/output logic element 115.

In the pictured embodiment, a columnar area near the center of the die (shown shaded in FIG. 1) is used for configuration, clock, and other control logic. Horizontal areas 109 extending from this column are used to distribute the clocks and configuration signals across the breadth of the FPGA.

Some FPGAs utilizing the architecture illustrated in FIG. 1 include additional logic blocks that disrupt the regular columnar structure making up a large part of the FPGA. The additional logic blocks can be programmable blocks and/or dedicated logic. For example, the processor block PROC 110 shown in FIG. 1 spans several columns of CLBs and BRAMs.

Note that FIG. 1 is intended to illustrate only an exemplary FPGA architecture. For example, the numbers of logic blocks in a column, the relative width of the columns, the number and order of columns, the types of logic blocks included in the columns, the relative sizes of the logic blocks, and the interconnect/logic implementations included at the top of FIG. 1 are purely exemplary. For example, in an actual FPGA more than one adjacent column of CLBs is typically included wherever the CLBs appear, to facilitate the efficient implementation of user logic, but the number of adjacent CLB columns varies with the overall size of the FPGA.

For many FPGA devices, such as FPGA 100 of FIG. 1, core logic elements such as CLBs 102 are powered by a main voltage supply (VDD), I/O circuitry such as IOBs 104 are powered by a separate auxiliary voltage supply (VCCAUX), where VCCAUX is typically greater than VDD, and the configuration memory cells are powered by a regulated voltage (Vgg) that is typically generated using a well-known bandgap reference voltage (Vbg_ref). In some FPGAs, for example, VDD has a voltage of between approximately 1.0-1.2 volts, VCCAUX has a voltage of approximately 2.5 volts, and Vgg is typically regulated to approximately one transistor threshold voltage (VT) above VDD (e.g., to between approximately 1.3-1.5 volts).

For example, FIG. 2 shows a simplified portion 200 of FPGA 100 that includes a bandgap reference voltage circuit 205, a VCCAUX voltage regulator circuit 210, a plurality of configuration memory cells 230, I/O circuitry 250, and core logic 260. Voltage regulator 210, which includes a PMOS transistor 211 and an operational amplifier (op-amp) 212, generates a regulated voltage Vgg at a power node A for powering memory cells 230, which store configuration bits (CB) that may be provided to control various configurable elements within I/O circuitry 250 and core logic 260 via signal lines 231A and 231B, respectively, which are shown collectively in FIG. 2 for simplicity. (Note that in the present specification, the same reference characters are used to refer to terminals, signal lines, and their corresponding signals and voltages.)

In VCCAUX voltage regulator circuit 210, PMOS transistor 211 is coupled between auxiliary voltage supply VCCAUX and node A, and has a well region tied to VCCAUX. Operational amplifier 212, which is well-known, includes a first input terminal coupled to receive a bandgap reference voltage Vbg_ref from bandgap reference voltage circuit 205, a second input terminal coupled to node A, and an output terminal coupled to the gate of PMOS transistor 211. Bandgap reference voltage circuit 205 can generate a value of Vbg_ref that is relatively insensitive to process and temperature variations, for example, so that configuration memory cells 230 which store logic high values of CB drive signal lines 231 with a CB signal having a voltage approximately equal to a specified value of Vgg, irrespective of the operating temperature.

FIG. 3 shows a programmable interconnect point (PIP) 300 that can be included, for example, in the programmable interconnect element 111 shown in FIG. 1. PIP 300 includes an NMOS pass transistor 310 and a configuration memory cell 230. NMOS pass transistor 310 is coupled between interconnect signal lines 303A and 303B, and has a gate terminal coupled to memory cell 230 via signal line 231. Memory cell 230 stores a CB that controls operation of NMOS pass transistor 310, and although not shown for simplicity in FIG. 3, includes a power terminal coupled to receive regulated voltage Vgg. CB is typically loaded into memory cell 230 during configuration of FPGA 100. During normal operation of FPGA 100, a logic high value of CB (e.g., CB≈Vgg) turns on transistor 310 and connects signal lines 303A-303B together, and conversely, a logic low value of CB (e.g., CB≈0 volts) turns off transistor 310 and isolates signal lines 303A-303B from each other. As mentioned above, regulated voltage Vgg is typically regulated to approximately one transistor threshold voltage VT above VDD. Because the voltage swing of logic signals on signal lines 303A-303B is typically between 0 volts and VDD, driving the gate of NMOS transistor 310 with a value of regulated voltage Vgg that is approximately one transistor threshold voltage VT greater than VDD allows NMOS transistor 310 to pass a logic high signal without a VT drop across transistor 310.

FIG. 4 illustrates a voltage supply circuit 400 in an exemplary FPGA, e.g., the FPGA of FIG. 2. Voltage supply circuit 400 includes bandgap circuit 410, regulator circuit 420, start-up circuit 430, and NMOS transistor MN2, and provides regulated voltage Vgg to memory cells 230 via regulated voltage node 440. Bandgap circuit 410 generates bandgap reference voltage Vbg_ref and supplies the bandgap reference voltage Vbg_ref to voltage regulator circuit 420, where Vbg_ref drives one input terminal of operational amplifier 422. The other input terminal of operational amplifier 422 is driven by regulated voltage node 440, and the output terminal of operational amplifier 422 provides pass voltage Vgg_pass. Note that some known voltage supply circuits include a resistor divider (not shown, but see FIG. 10) on the feedback path between regulated voltage node 440 and operational amplifier 422, while in other voltage supply circuits the reference voltage Vbg_ref is brought up to the Vgg voltage level. Regulator circuit 420 also includes PMOS pull-up transistors MP1 and MP2, coupled in series between auxiliary voltage supply VCCAUX and regulated voltage node 440. The gate terminal of PMOS transistor MP1 is coupled to receive pass voltage Vgg_pass. The gate terminal of PMOS transistor MP2 is coupled to receive a power down signal PDNB, inverted by inverter 421. The bodies of PMOS transistors MP1 and MP2 are coupled to VCCAUX, e.g., through well biasing.

Start-up circuit 430 includes PMOS transistor MP3 and NMOS transistor MN1. PMOS transistor MP3 and NMOS transistor MN1 are coupled in series between VCCAUX and regulated voltage node 440, with the gate of PMOS transistor MP3 coupled to ground GND and the gate of NMOS transistor MN1 receiving a voltage clamp signal CLMP.

NMOS transistor MN2 is a diode-connected transistor coupled between regulated voltage node 440 and ground GND, and provides current for a closed loop phase margin, as is described in more detail below.

For simplicity, FIG. 4 omits the one or more well-known unity-gain buffers that may be coupled between the output of operational amplifier 422 and the gate of transistor MP1. In addition, although not shown for simplicity, bandgap reference voltage Vbg_ref may be provided to a plurality of regulator circuits 420 and start-up circuits 430 distributed across the integrated circuit. Also not shown for simplicity, a single operational amplifier 422 can be used to drive many pull-up transistors MP1 and MP2, if desired.

Voltage supply circuit 400 functions as follows. During operation of the integrated circuit, bandgap circuit 410 provides a bandgap reference voltage Vbg_ref, using any of many known methods. Operational amplifier 422 is well known, and generates a value for pass voltage Vgg_pass that results in a negligible voltage differential between its input terminals, thereby maintaining the regulated voltage Vgg approximately equal to the voltage of bandgap reference voltage Vbg_ref. Pass voltage Vgg_pass, which controls the conductivity of PMOS transistor MP1, is adjusted by operational amplifier 422 so that the current provided by MP1 pulls up the voltage of regulated voltage Vgg in response to dips in Vgg caused by leakage current in memory cells 230 and/or current from transistor MN2. (Note that power down signal PDNB is high while the integrated circuit is operating, so the output of inverter 421 is low and PMOS transistor MP2 is on.) In this manner, the dynamic current provided by PMOS transistor MP1 compensates for leakage current in memory cells 230 to maintain the regulated voltage Vgg at the desired voltage level (e.g., Vbg_ref).

Start-up circuit 430, which is well-known, is primarily used during device power-up operations. For example, upon device power-on, voltage clamp signal CLMP is driven to a positive voltage that turns on transistor MN1 to quickly charge regulated voltage Vgg until Vgg reaches a level that causes transistor MN1 to turn off, for example, when regulated voltage Vgg becomes greater than one threshold voltage VT below the voltage of voltage clamp signal CLMP. In this manner, when operational amplifier 422 becomes operational, the reference voltage Vgg is sufficient to allow operational amplifier 422 to operate normally (i.e., to avoid overshoot conditions).

An important characteristic of voltage supply circuits is the value of the phase margin. As shown in FIG. 4, voltage supply circuits have the inherent characteristic that the regulated voltage Vgg is controlled using negative feedback. In other words, the voltage supply circuit includes a loop, which in the circuit of FIG. 4 includes the path through operational amplifier 422, via pass voltage Vgg_pass to PMOS transistor MP1, and back to operational amplifier 422 via PMOS transistor MP2 and regulated voltage node 440. In adverse conditions (e.g., in high temperatures, or in an integrated circuit manufactured at the fast process corner) such a loop can begin to oscillate. If the phase margin of the circuit is sufficiently large, the oscillation will die out. If the phase margin of the circuit is too small, the loop will continue to oscillate and the integrated circuit will not function properly. Therefore, it is desirable to increase the phase margin of a voltage supply circuit.

A reduction in the phase margin of a voltage regulator circuit can have many causes. For example, a variation in temperature can cause a reduction in phase margin. Further, an integrated circuit manufactured in one corner of the fabrication process can have a lower phase margin that an otherwise identical integrated circuit manufactured at a different process corner. The size of NMOS transistor MP1 is typically selected to handle the leakage current under worst-case conditions, plus a margin of error, typically resulting in an overdesign of transistor strength. The larger size of transistor MP1 increases the loop gain of the circuit, which further reduces the phase margin.

One known method of increasing the phase margin is illustrated in FIG. 4. The addition of a diode to ground (e.g., NMOS transistor MN2, coupled as shown in FIG. 4) can increase the phase margin by providing for additional leakage current between regulated voltage Vgg and ground GND. This additional leakage current makes the current requirements more predictable across temperature and process variations, by increasing the current requirements for all of the integrated circuits. Because the current requirements are more predictable, regulator circuit 420 can be better designed (e.g., transistor MP1 can be properly sized) to provide a consistent phase margin across temperature and process variations. However, the addition of such "leaker circuits" (e.g., transistor MN2) increases the power consumption of the integrated circuit. Further, this approach is of limited value, because it does not address the increase in loop gain caused by the increasing loads as integrated circuits increase in size.

Therefore, it is desirable to provide additional circuits and methods of increasing the phase margin of a supply voltage circuit in an integrated circuit.

SUMMARY OF THE INVENTION

The invention provides a voltage supply circuit having variable drive strength that can be used, for example, to provide improved phase margin in an integrated circuit. A bandgap circuit drives an operational amplifier, with the second input of the operational amplifier being a regulated voltage node. The operational amplifier drives multiple pull-ups in a pull-up network coupled to the regulated voltage node, of which the different pull-ups can be separately enabled to control the effective channel width of the pull-up network. In some embodiments, a control circuit accepts the output of the operational amplifier as an input signal and provides multiple enable signals to the pull-up network. In some embodiments, the control circuit includes a second operational amplifier driven by the first operational amplifier and a reference voltage signal, and in turn driving a counter that provides the enable signals to the pull-up network. In some embodiments, the control circuit also includes a third operational amplifier driven by the first operational amplifier and a second reference voltage signal. The third operational amplifier drives the counter in the opposite direction from the second operational amplifier.

Some embodiments also include one or more of a start-up circuit coupled to the regulated voltage node, a diode coupled between the regulated voltage node and ground, and/or one or more programmable logic circuits coupled between a regulated voltage node and ground.

In some embodiments, the bandgap circuit includes two bandgap generators having different performance characteristics, both bandgap generators driving a select circuit that selects between output signals from the two bandgap generators based on temperature or other operating conditions.

BRIEF DESCRIPTION OF THE DRAWINGS

The present invention is illustrated by way of example, and not by way of limitation, in the following figures.

DETAILED DESCRIPTION OF THE DRAWINGS

The present invention is applicable to a variety of integrated circuits (ICs). The present invention has been found to be particularly applicable and beneficial for programmable logic devices (PLDs). Therefore, an appreciation of the present invention is presented by way of specific examples utilizing PLDs such as field programmable gate arrays (FPGAs). However, the present invention is not limited by these examples, and it will be apparent to those of skill in the art that many embodiments of the present invention can be applied to programmable, non-programmable, and/or partially programmable integrated circuits.

Further, in the following description numerous specific details are set forth to provide a more thorough understanding of the present invention. However, it will be apparent to one skilled in the art that the present invention can be practiced without these specific details.

Figure 1:
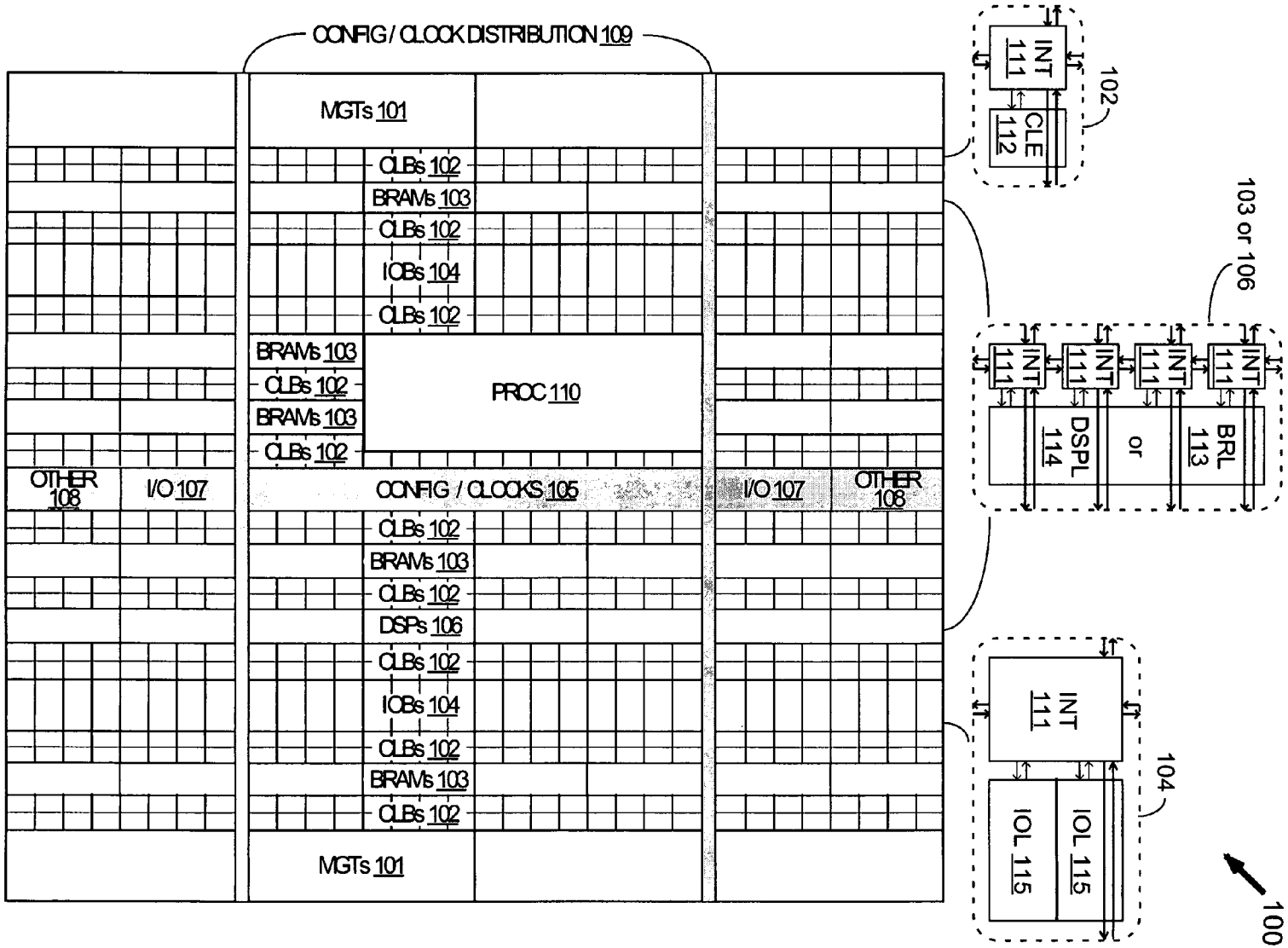
FIG. 1 (Prior Art)
FIG. 1 illustrates an known architecture for an exemplary field programmable gate array (FPGA).
Figure 2:
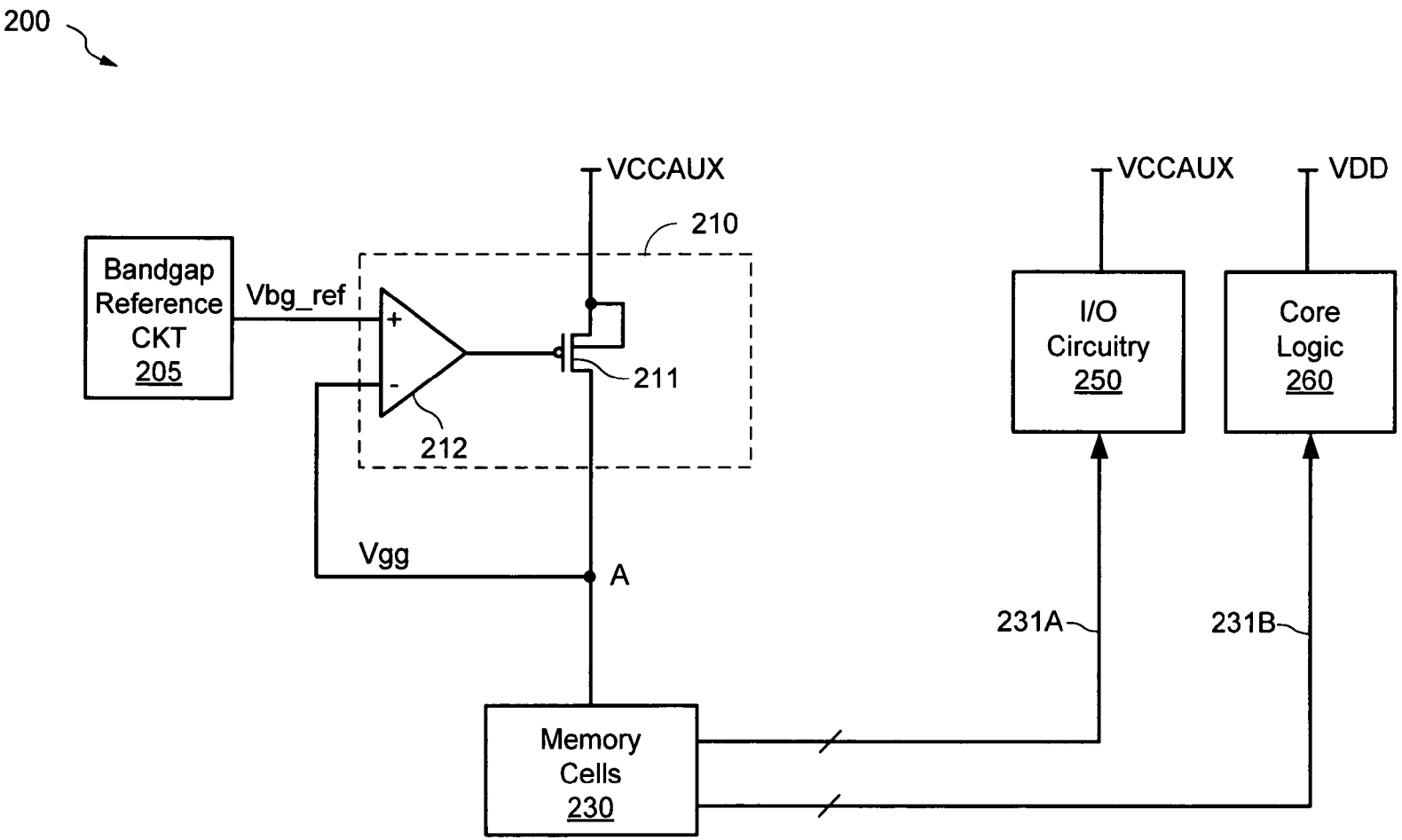
FIG. 2 (Prior Art)
FIG. 2 illustrates a portion of the FPGA of FIG. 1.
Figure 3:
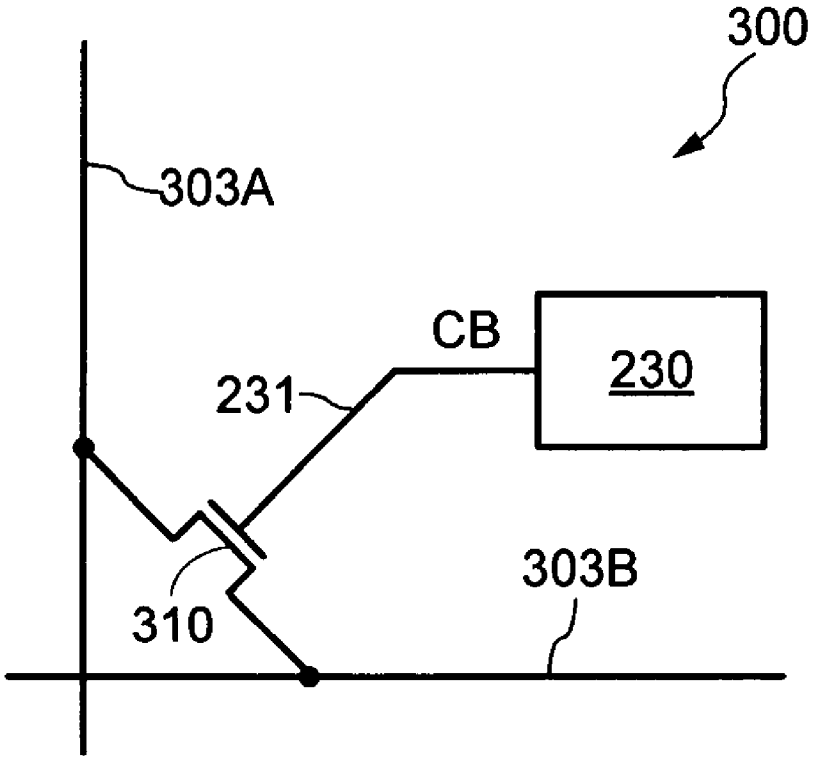
FIG. 3 (Prior Art)
FIG. 3 shows a programmable interconnect point (PIP) that can be included, for example, in the FPGA of FIG. 1.
Figure 4:
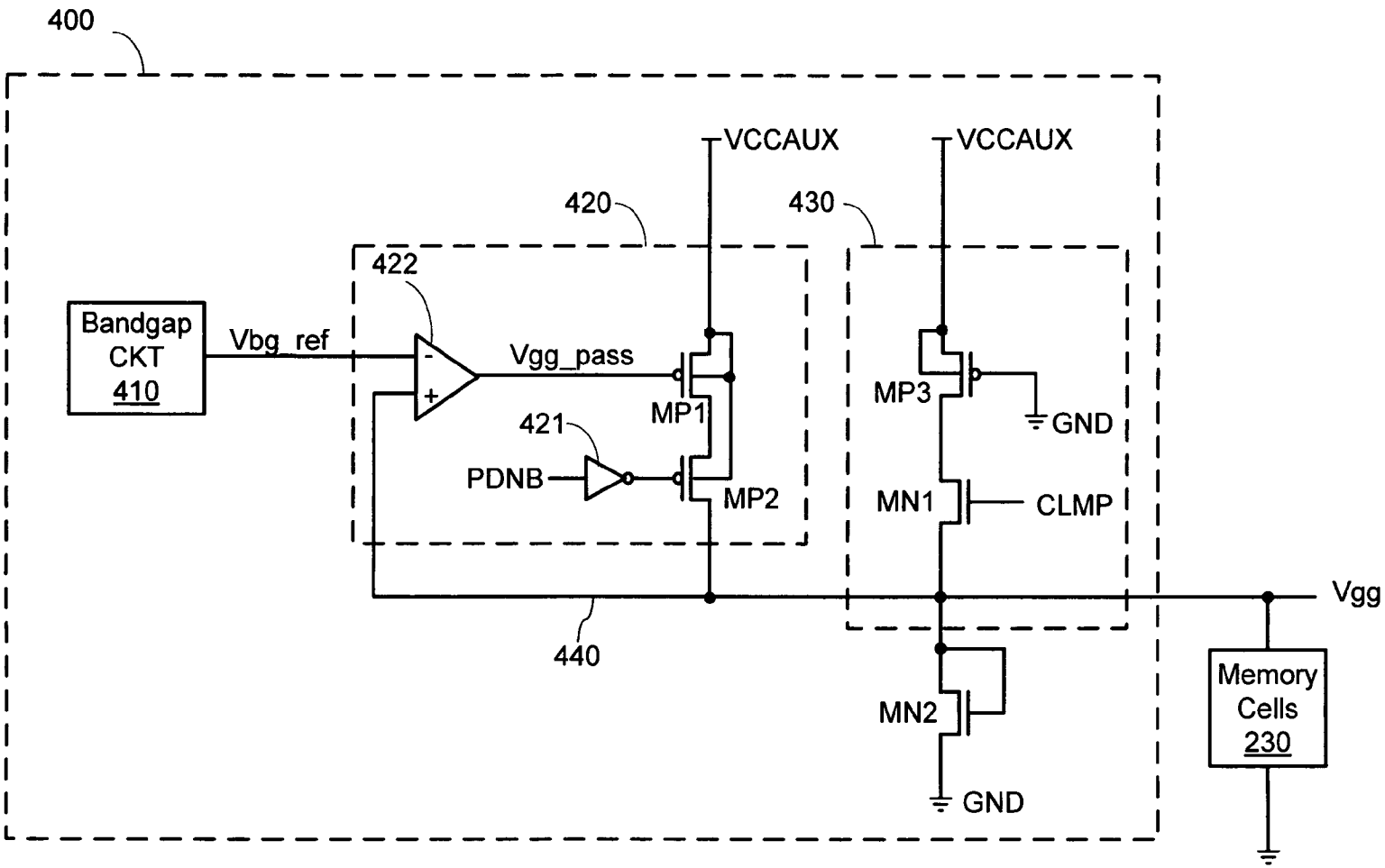
FIG. 4 (Prior Art)
FIG. 4 illustrates a known voltage supply circuit in an exemplary FPGA.
Figure 5:
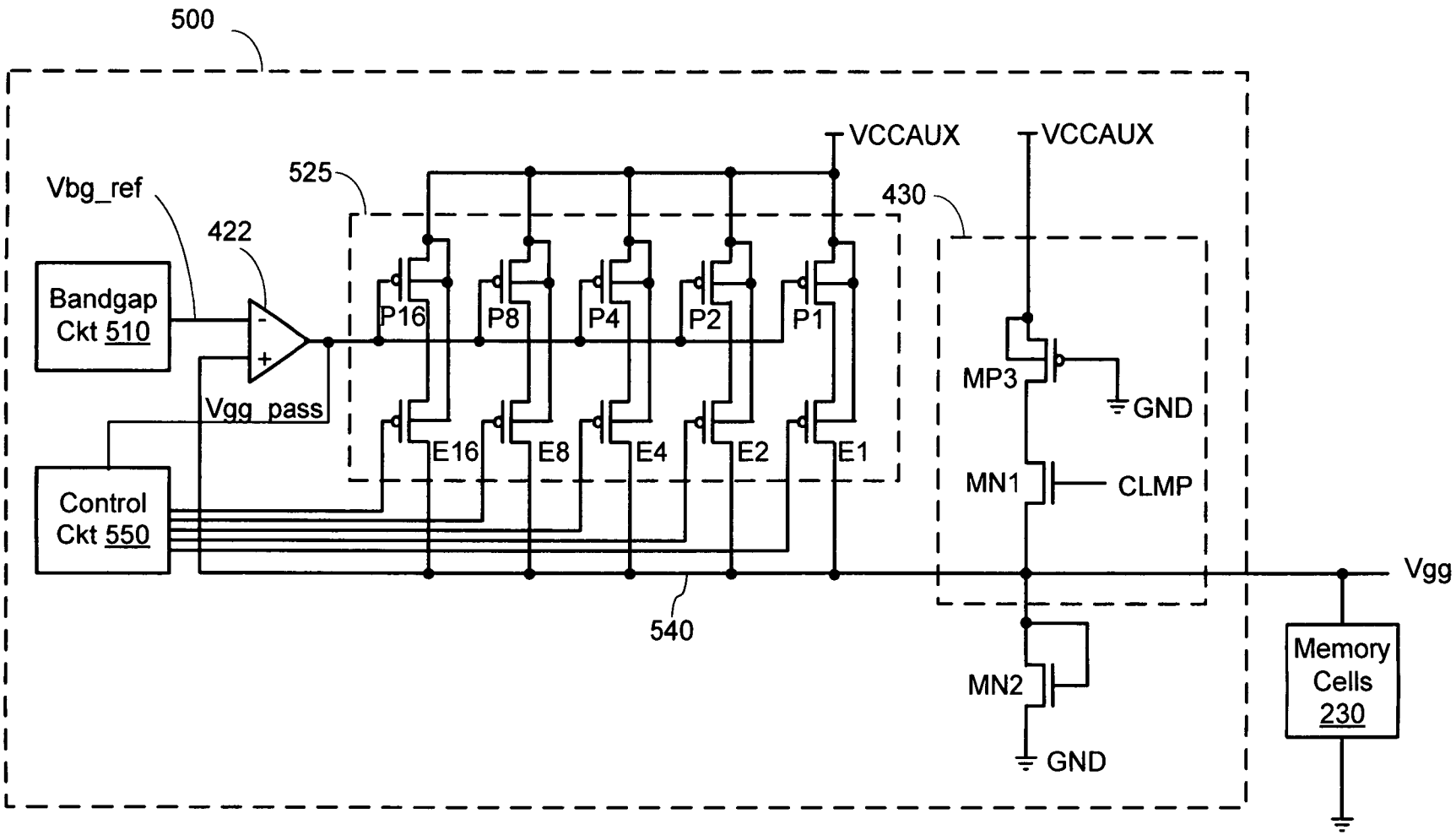
FIG. 5 illustrates a first novel voltage supply circuit that can be included, for example, in a programmable logic device such as an FPGA.

FIG. 5 illustrates a first novel voltage supply circuit 500 that can be included, for example, in a programmable logic device. Voltage supply circuit 500 of FIG. 5 includes a bandgap circuit 510, an operational amplifier 422, a pull-up network 525, a start-up circuit 430, a leaker circuit (diode-coupled transistor) MN2, and a control circuit 550, coupled together as shown in FIG. 5. Operational amplifier 422, start-up circuit 430, and leaker circuit MN2 can be implemented using known techniques, if desired. For example, these elements can be implemented in the same fashion as the similarly-numbered elements included in known voltage supply circuit 400 of FIG. 4. Bandgap circuit 510 can be implemented in the same fashion as bandgap circuit 410 of FIG. 4, if desired. However, other possible implementations for bandgap circuit 510 are presented below, in conjunction with FIGS. 9 and 11.

In the pictured embodiment, pull-up network 525 includes five pull-up transistors P1, P2, P4, P8, and P16. In the pictured embodiment, pull-up transistors P1, P2, P4, P8, and P16 are implemented as PMOS transistors with bodies tied to the auxiliary voltage supply VCCAUX. In other embodiments, the pull-up transistors are implemented using other techniques. In the pictured embodiment, P1 has a first channel width, P2 has twice the channel width of transistor P1, P4 has four times the channel width of transistor P1, and so forth. Each pull-up transistor has a source terminal coupled to the auxiliary voltage supply VCCAUX, and a gate terminal coupled to the pass voltage output terminal Vgg_pass of operational amplifier 422. Each pull-up transistor P1, P2, P4, P8, and P16 has a drain terminal coupled to the source terminal of an enable transistor E1, E2, E4, E8, and E16, respectively. In the pictured embodiment, enable transistors E1, E2, E4, E8, and E16 are implemented as PMOS transistors with bodies tied to VCCAUX. The drain terminals of the enable transistors are coupled to regulated voltage node 540. The gate terminal of each enable transistor is coupled to receive a different enable signal from control circuit 550.

In some embodiments (not shown), fewer or more than five pull-up transistors and five enable transistors are included in the pull-up network. In other embodiments, the pull-up transistors have different relative sizes, and/or the enable transistors have different relative sizes. In some embodiments, the pull-up transistors and/or the enable transistors are laid out as multiple smaller transistors. In one embodiment, for example, transistor P1 is laid out as one unit transistor, transistor P2 is laid out as two unit transistors, transistor P4 is laid out as four unit transistors, and so forth.

For simplicity, FIG. 5 omits the one or more well-known unity-gain buffers that may be coupled between the output of operational amplifier 422 and the input terminal of pull-up transistor network 525. In addition, although not shown for simplicity, bandgap reference voltage Vbg_ref may be provided to a plurality of operational amplifiers distributed across the integrated circuit.

Figure 6:
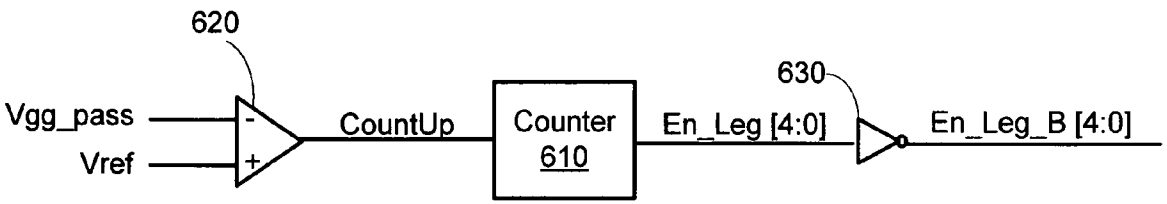
FIG. 6 illustrates a first exemplary control circuit that can be included, for example, in the voltage supply circuit of FIG. 5.

Control circuit 550 can be implemented, for example, as shown in FIG. 6. The control circuit of FIG. 6 includes a second operational amplifier 620. Operational amplifier 620 has two input terminals coupled to receive pass voltage Vgg_pass and an input reference voltage Vref, and a CountUp output terminal. The CountUp output signal drives up counter 610, which provides the enable signals En_Leg[4:0] to pull-up transistor network 525 (see FIG. 5).

In some embodiments (not shown), control circuit 550 is coupled to receive a power down signal, which is then gated with the enable output signals. For example, in some embodiments the power down signal is active low, i.e., has a high value when the circuit is operating. In one such embodiment, inverters 630 are replaced by NAND gates driven by signals En_Leg[4:0] and the power down signal. Thus, when the integrated circuit is powered down (i.e., the power down signal is low), the enable signals are all high, i.e., none of the pull-ups are enabled. When the integrated circuit is operating (i.e., the power down signal is high), the enable control signals En_Leg_B[4:0] behave in the same fashion as the circuit shown in FIG. 6.

Returning now to FIG. 5, voltage supply circuit 500 includes the basic functionality of voltage supply circuit 400 of FIG. 4. During operation of the integrated circuit, bandgap circuit 510 provides bandgap reference voltage Vbg_ref, e.g., using known methods or the methods described below in conjunction with FIGS. 9 and 11. Operational amplifier 422 is well known, and generates a value for pass voltage Vgg_pass that results in a negligible voltage differential between its input terminals, thereby maintaining the regulated voltage Vgg approximately equal to the voltage of bandgap reference voltage Vbg_ref. Pass voltage Vgg_pass, which drives the pull-up transistor network 525, is adjusted by operational amplifier 422 so that the current provided by pull-up transistor network 525 pulls up regulated voltage Vgg in response to dips in Vgg caused by leakage current in memory cells 230. In this manner, the dynamic current provided by pull-up transistor network 525 compensates for leakage current in memory cells 230 to maintain the regulated voltage Vgg at the desired voltage level (e.g., Vbg_ref).

However, voltage supply circuit 500 has an added functionality, which allows the effective channel width of the pull-up network 525 to be dynamically controlled. This capability allows voltage supply circuit 500 to avoid reducing phase margin more than is necessary to enable proper functioning of the integrated circuit. This capability is provided by control circuit 550 and the configurable nature of pull-up transistor network 525. In brief, control circuit 550 continually checks the regulated voltage Vgg and tries to keep the regulated voltage Vgg at a desired level, by adjusting the strength of pull-up network 525, e.g., by turning on and off additional pull-ups in the network.

Under some conditions (e.g., at some temperatures or process corners), more current passes through memory cells 230. This increase in current acts to reduce regulated voltage Vgg, by reducing pass voltage Vgg_pass. To overcome this response (i.e., to restore the preferred value of Vgg_pass), control circuit 550 simply enables more pull-ups, as follows. When regulated voltage Vgg is reduced, pass voltage Vgg_pass is also reduced. Operational amplifier 620 (see FIG. 6) detects that the pass voltage Vgg_pass has gone below a target voltage defined by reference voltage Vref, and signal CountUp goes high. The value stored in counter 610 increases, and the value represented by signals En_Leg[4:0] also increases. In other words, one or more of signals En_Leg[4:0] changes from a low value to a high value. Signals En_Leg[4:0] are inverted by inverters 630 (5 inverters, in the illustrated embodiment), therefore one or more of enable control signals En_Leg_B[4:0] changes from a high value to a low value. One or more additional pull-ups in pull-up network 525 are enabled, increasing the drive strength (i.e., increasing the effective channel width) of pull-up network 525. Pass voltage Vgg_pass increases toward the desired level.

In the pictured embodiment, enable control signal En_Leg_B[4] controls the P16 pull-up, enable control signal En_Leg_B[3] controls the P8 pull-up, enable control signal En_Leg_B[2] controls the P4 pull-up, enable control signal En_Leg_B[1] controls the P2 pull-up, and enable control signal En_Leg_B[0] controls the P1 pull-up. Thus, a more significant bit of the value stored in counter 610 has a larger impact on the effective channel width of pull-up network 525 than a less significant bit, with the effect of each bit being twice as strong as the effect of the next less significant bit. In other embodiments, the relationships between the enable signals and the pull-up transistors follow other patterns.

Under other conditions (e.g., at different temperatures or process corners), less current passes through memory cells 230. This reduction in current acts to increase regulated voltage Vgg, by increasing pass voltage Vgg_pass. In this situation (i.e., to restore the preferred value of Vgg_pass), control circuit 550 enables fewer pull-ups, as follows. When regulated voltage Vgg increases, pass voltage Vgg_pass also increases. Operational amplifier 620 (see FIG. 6) detects that the pass voltage Vgg_pass has gone above a target voltage defined by reference voltage Vref, and signal CountUp goes low. The value stored in counter 610 decreases, and the value represented by signals En_Leg[4:0] also decreases. In other words, one or more of signals En_Leg[4:0] changes from a high value to a low value. Signals En_Leg[4:0] are inverted by inverters 630, therefore one or more of enable control signals En_Leg_B[4:0] changes from a low value to a high value. One or more additional pull-ups in pull-up network 525 is disabled, decreasing the drive strength (i.e., decreasing the effective channel width) of pull-up network 525. Pass voltage Vgg_pass decreases toward the desired level.

Clearly, the maximum current that can be handled by the pull-up network 525 should be more than the estimated worst case leakage from memory cells 230, plus a safety margin. In other words, the total number of pull-ups in pull-up network 525 must be large enough to cover the most severe anticipated leakage current, plus the safety margin. In known voltage supply circuits, the pull-up strength is typically over-designed for most applications. In the voltage supply circuit of FIG. 5, under these conditions the number of active pull-ups can be reduced by disabling the unneeded pull-ups, which reduces the gain of the closed loop, which in turn improves the phase margin of the circuit.

Figure 7:
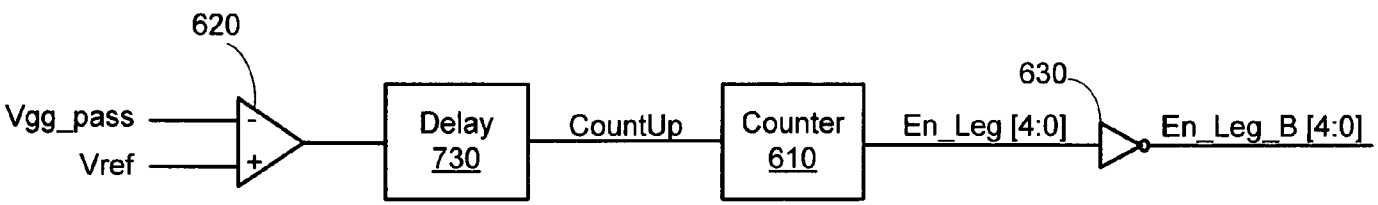
FIG. 7 illustrates a second exemplary control circuit that can be included, for example, in the voltage supply circuit of FIG. 5.

In some embodiments, a delay element 730 is included between operational amplifier 620 and counter 610, as shown in FIG. 7. This delay element increases the response time of the control circuit, reducing the volatility of enable control signals En_Leg_B[4:0]. For example, delay element 730 can prevent the effective channel width of pull-up network 525 from increasing or decreasing past the desired point, before control circuit 550 can detect the fact that the optimum setting has been reached. In some embodiments, delay element 730 prevents counter 610 from changing values continuously (e.g., adding one, subtracting one, adding one, subtracting one . . . ) at a frequency that might interfere with the Vgg feedback loop.

Figure 8:
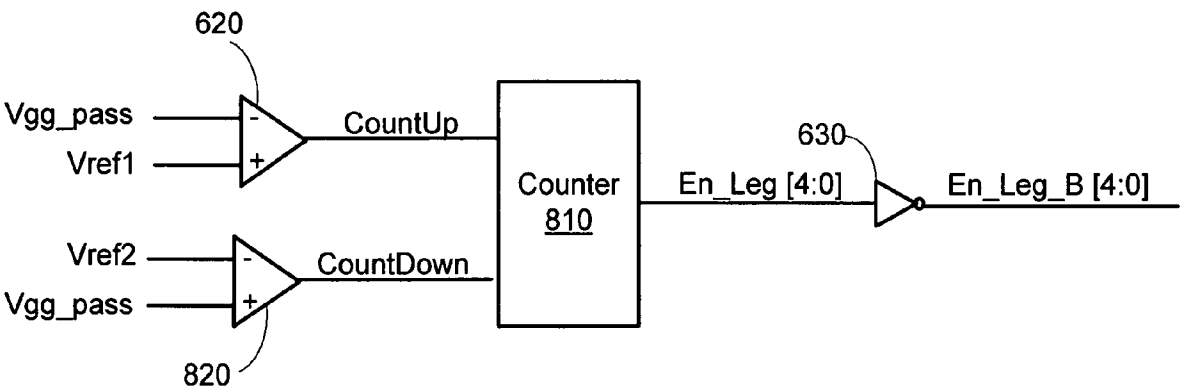
FIG. 8 illustrates a third exemplary control circuit that can be included, for example, in the voltage supply circuit of FIG. 5.

FIG. 8 illustrates another embodiment of control circuit 550. In this embodiment, a range of acceptable voltage levels is specified for regulated voltage Vgg, e.g., Vref1≦Vref≦Vref2. When regulated voltage Vgg falls below a first reference voltage Vref1, operational amplifier 620 detects the change, and signal CountUp goes high. The value stored in counter 810 increases in value, and one or more of signals En_Leg[4:0] changes from a low value to a high value. One or more of enable control signals En_Leg_B[4:0] changes from a high value to a low value. One or more additional pull-ups in pull-up network 525 is enabled, increasing the drive strength of pull-up network 525. Regulated voltage Vgg increases towards the desired level.

When regulated voltage Vgg rises above a second reference voltage Vref2, operational amplifier 820 detects the change, and signal CountDown goes high. The value stored in counter 810 decreases in value, and one or more of signals En_Leg[4:0] changes from a high value to a low value. One or more of enable control signals En_Leg_B[4:0] changes from a low value to a high value. One or more additional pull-ups in pull-up network 525 is disabled, decreasing the drive strength of pull-up network 525. Regulated voltage Vgg decreases towards the desired level.

Figure 9:
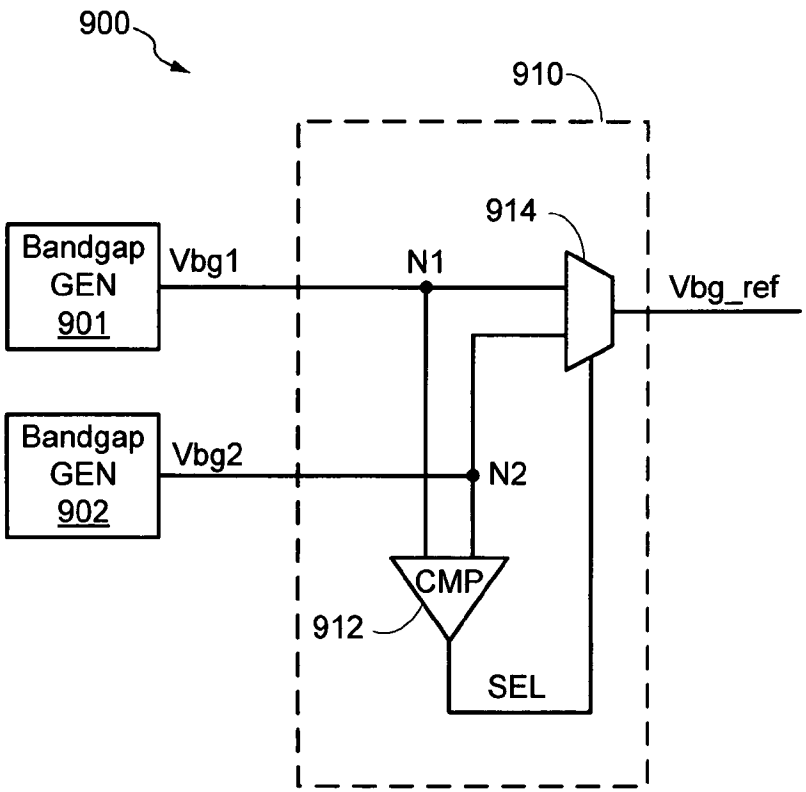
FIG. 9 illustrates an exemplary bandgap circuit that can be included, for example, in the voltage supply circuit of FIG. 5.

FIG. 9 illustrates an exemplary bandgap circuit 900 that can be included, for example, in the voltage supply circuit of FIG. 5. Bandgap circuit 900 includes first and second bandgap generators 901, 902 and a select circuit 910, which includes a comparator (CMP) 912 and a multiplexer 914. These elements are coupled together as shown in FIG. 9.

Bandgap circuit 900 functions as follows. First bandgap generator 901 provides voltage Vbg1 to a first input terminal of comparator 912 and to a first input terminal of multiplexer 914, via node N1. Second bandgap generator 902 provides voltage Vbg2 to a second input terminal of comparator 912 and to a second input terminal of multiplexer 914, via node N2. Comparator 912 provides a select signal SEL to the control terminal of multiplexer 914, where signal SEL indicates whether the voltage of Vbg1 is less than the voltage of Vbg2. Multiplexer 914 has an output terminal to provide either Vbg1 or Vbg2 as bandgap reference voltage Vbg_ref in response to select signal SEL.

In one embodiment, voltage Vbg1 has a negligible temperature coefficient and thus is relatively insensitive to temperature variations, and voltage Vbg2 has a negative temperature coefficient and thus is inversely proportional to the operating temperature. In other embodiments, voltages Vbg1 and/or Vbg2 have other suitable temperature coefficients.

In one embodiment, bandgap circuit 900 functions as follows. First bandgap generator 901 generates voltage Vbg1 as having a substantially zero temperature coefficient, and second bandgap generator 902 generates voltage Vbg2 as having a negative temperature coefficient, as described above. Comparator 912 compares the value of voltage Vbg1 at node N1 with the value of voltage Vbg2 at node N2, and in response thereto generates select signal SEL. In the pictured embodiment, if voltage Vbg1 is less than voltage Vbg2, comparator 912 drives select signal SEL to a first state, which causes multiplexer 914 to provide voltage Vbg1 as bandgap reference voltage Vbg_ref to operational amplifier 422 (see FIG. 5). Conversely, if voltage Vbg1 is greater than or equal to voltage Vbg2, comparator 912 drives select signal SEL to a second state, which causes multiplexer 914 to provide voltage Vbg2 as bandgap reference voltage Vbg_ref to operational amplifier 422.

Figure 10:
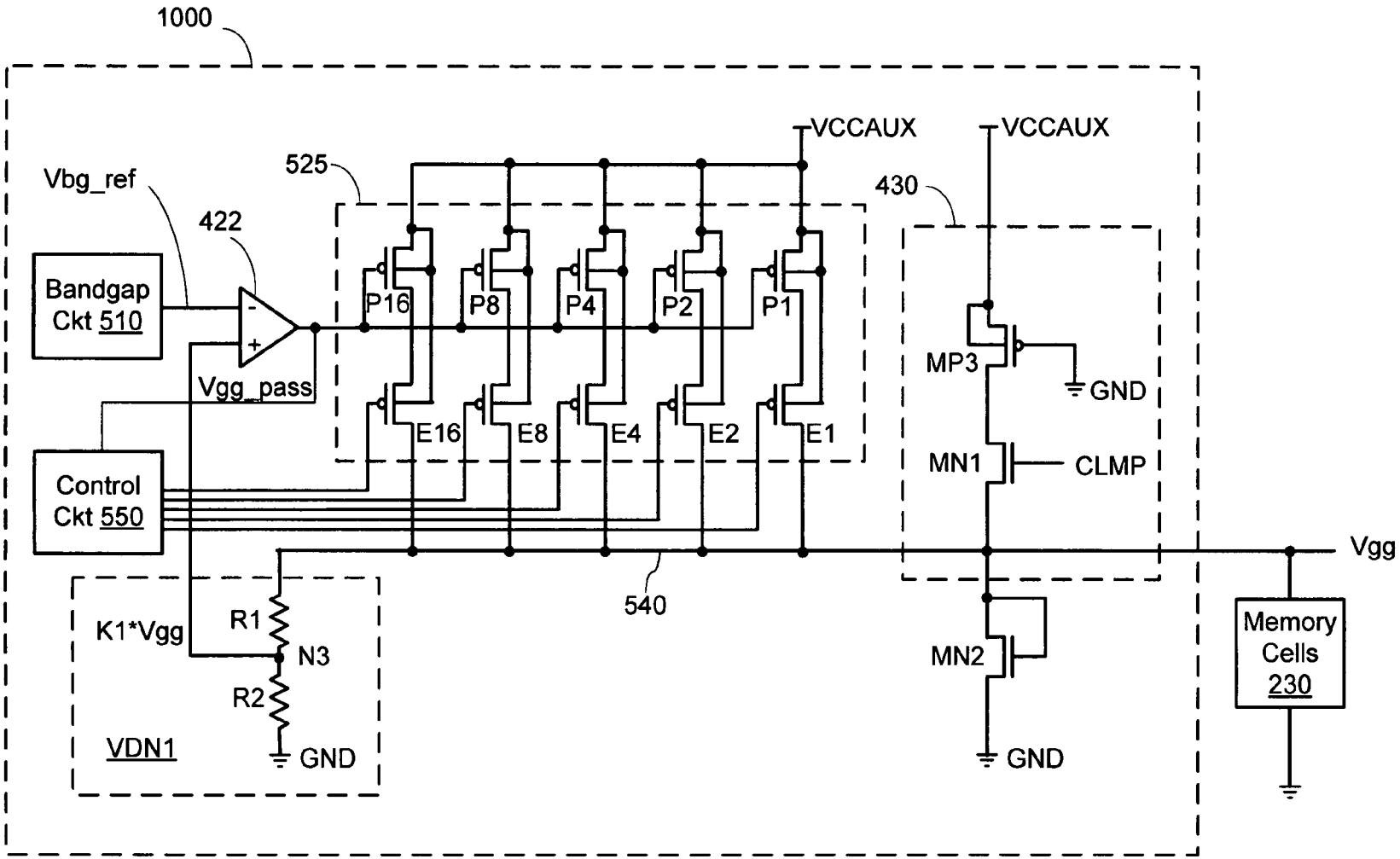
FIG. 10 illustrates a second novel voltage supply circuit that can be included, for example, in a programmable logic device such as an FPGA.

FIG. 10 illustrates a second novel voltage supply circuit 1000 that can be included, for example, in a programmable logic device. Voltage supply circuit 1000 is similar to voltage supply circuit 500 of FIG. 5. Therefore, only the differences are described here.

Voltage supply circuit 1000 includes a voltage divider network VDN1 coupled between regulated voltage node 540 and the input terminal of operational amplifier 422, as illustrated in FIG. 10. Voltage divider network VDN1 includes resistors R1 and R2, coupled together in series between regulated voltage node 540 and ground as shown in FIG. 10. Voltage divider network VDN1 provides a ratioed voltage of K1*Vgg to operational amplifier 422, where the value of K1 is determined by the relative resistances of resistors R1 and R2.

Figure 11:
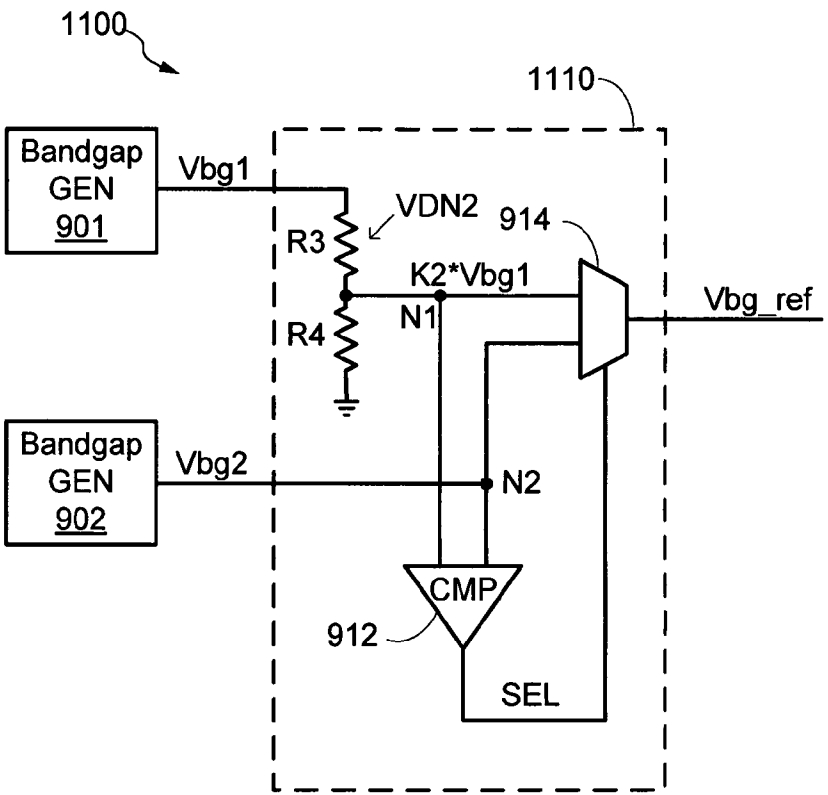
FIG. 11 illustrates an exemplary bandgap circuit that can be included, for example, in the voltage supply circuits of FIGS. 5 and 10.

FIG. 11 illustrates an exemplary bandgap circuit 1100 that can be included, for example, in the voltage supply circuits of FIGS. 5 and/or 10. Bandgap circuit 1100 is similar to bandgap circuit 900 of FIG. 9. Therefore, only the differences are described here.

Bandgap circuit 1100 includes a second voltage divider network VDN2 coupled between voltage Vbg1 and node N1, as illustrated in FIG. 11. Voltage divider network VDN2 includes resistors R3 and R4, coupled together in series between Vbg1 and ground as shown in FIG. 10. Voltage divider network VDN2 provides a ratioed voltage of K2*Vbg1 to comparator 912 and multiplexer 914, where the value of K2 is determined by the relative resistances of resistors R3 and R4. Further, although not shown in FIG. 11 for simplicity, bandgap circuit 1100 may include a third voltage divider network that provides a ratioed Vbg2 voltage of K3*Vbg2 to node N2, where the value of K3 is determined by the relative resistances of the resistors (not shown) which form the third voltage divider network.

As described above with respect to the various exemplary embodiments of bandgap circuit 510, first bandgap generator 901 generates a waveform for voltage Vbg1 that is relatively insensitive to process and temperature variations, and second bandgap generator 902 generates a waveform for voltage Vbg2 that has a negative temperature coefficient. However, in other embodiments first bandgap generator 901 may generate a voltage Vbg1 having a negative temperature coefficient, having a positive temperature coefficient, or that is relatively insensitive to temperature variations. Similarly, in other embodiments, second bandgap generator 902 may generate a voltage Vbg2 having a negative temperature coefficient, having a positive temperature coefficient, or that is relatively insensitive to temperature variations.

In addition, although described above as using the lesser of Vbg1 and Vbg2 to generate bandgap reference voltage Vbg_ref, in other embodiments, the bandgap circuits may be configured to use the greater of Vbg1 and Vbg2 to generate bandgap reference voltage Vbg_ref.

It will be apparent to one skilled in the art after reading this specification that the present invention can be practiced within these and other architectural variations.

Those having skill in the relevant arts of the invention will now perceive various modifications and additions that can be made as a result of the disclosure herein. For example, resistors, bandgap circuits, bandgap generators, control circuits, pull-ups, pull-up networks, start-up circuits, transistors, PMOS transistors, NMOS transistors, diodes, leaker circuits, operational amplifiers (op-amps), memory cells, and other components other than those described herein can be used to implement the invention. Active-high signals can be replaced with active-low signals by making straightforward alterations to the circuitry, such as are well known in the art of circuit design. Logical circuits can be replaced by their logical equivalents by appropriately inverting input and output signals, as is also well known.

Moreover, some components are shown directly connected to one another while others are shown connected via intermediate components. In each instance the method of interconnection establishes some desired electrical communication between two or more circuit nodes. Such communication can often be accomplished using a number of circuit configurations, as will be understood by those of skill in the art.

Accordingly, all such modifications and additions are deemed to be within the scope of the invention, which is to be limited only by the appended claims and their equivalents.

What is claimed is:

1. A voltage supply circuit, comprising:

a bandgap circuit having a bandgap voltage output terminal;

a first operational amplifier having a first input terminal coupled to the bandgap voltage output terminal of the bandgap circuit, a second input terminal coupled to a regulated voltage node, and a pass voltage output terminal;

a plurality of pull-up transistors each having a source terminal coupled to a power supply terminal, a gate terminal coupled to the pass voltage output terminal of the first operational amplifier; and a drain terminal; and a plurality of enable transistors, each enable transistor being coupled between a corresponding one of the drain terminals of the pull-up transistors and the regulated voltage node, each enable transistor having a gate terminal coupled to receive a separate enable signal.

2. The voltage supply circuit of claim 1, further comprising:

a start-up circuit coupled between the power supply terminal and the regulated voltage node.

3. The voltage supply circuit of claim 1, further comprising:

a diode coupled between the regulated voltage node and a ground terminal.

4. The voltage supply circuit of claim 1, further comprising:

a control circuit having an input terminal coupled to the pass voltage output terminal of the first operational amplifier, and further having a plurality of output terminals each coupled to the gate terminal of a corresponding one of the enable transistors.

5. The voltage supply circuit of claim 4, wherein the control circuit comprises:

a second operational amplifier having a first input terminal coupled to the pass voltage output terminal of the first operational amplifier, a second input terminal coupled to a first reference voltage input terminal, and an output terminal; and a counter having a first input terminal coupled to the output terminal of the second operational amplifier, and further having a plurality of output terminals each coupled to a corresponding one of the output terminals of the control circuit.

6. The voltage supply circuit of claim 5, further comprising:

a delay element coupled between the output terminal of the second operational amplifier and the first input terminal of the counter.

7. The voltage supply circuit of claim 5, wherein the control circuit further comprises:

a third operational amplifier having a first input terminal coupled to a second reference voltage input terminal, a second input terminal coupled to the pass voltage output terminal of the first operational amplifier, and an output terminal coupled to a second input terminal of the counter.

8. The voltage supply circuit of claim 1, wherein the bandgap circuit comprises:

a first bandgap generator having an output terminal;

a second bandgap generator having an output terminal; and a select circuit having a first input terminal coupled to the output terminal of the first bandgap generator, a second input terminal coupled to the output terminal of the second bandgap generator, and an output terminal coupled to the output terminal of the bandgap circuit.

9. An integrated circuit, comprising:

a bandgap circuit having a bandgap voltage output terminal;

a first operational amplifier having a first input terminal coupled to the bandgap voltage output terminal of the bandgap circuit, a second input terminal coupled to a regulated voltage node, and a pass voltage output terminal;

a pull-up network coupled between a power supply terminal and the regulated voltage node, the pull-up network having a first input terminal coupled to the pass voltage output terminal of the first operational amplifier, and further having a plurality of enable input terminals; and a control circuit having an input terminal coupled to the pass voltage output terminal of the first operational amplifier, and further having a plurality of output terminals each coupled to a corresponding one of the enable input terminals of the pull-up network.

10. The integrated circuit of claim 9, further comprising:

a start-up circuit coupled between the power supply terminal and the regulated voltage node.

11. The integrated circuit of claim 9, further comprising:

a diode coupled between the regulated voltage node and a ground terminal.

12. The integrated circuit of claim 9, wherein the control circuit comprises:

a second operational amplifier having a first input terminal coupled to the pass voltage output terminal of the first operational amplifier, a second input terminal coupled to a first reference voltage input terminal, and an output terminal; and a counter having an input terminal coupled to the output terminal of the second operational amplifier, and further having a plurality of output terminals each coupled to a corresponding one of the output terminals of the control circuit.

13. The integrated circuit of claim 12, further comprising:

a delay element coupled between the output terminal of the second operational amplifier and the input terminal of the counter.

14. The integrated circuit of claim 12, wherein the control circuit further comprises:

a third operational amplifier having a first input terminal coupled to a second reference voltage input terminal, a second input terminal coupled to the pass voltage output terminal of the first operational amplifier, and an output terminal coupled to a second input terminal of the counter.

15. The integrated circuit of claim 9, wherein the bandgap circuit comprises:

a first bandgap generator having an output terminal;

a second bandgap generator having an output terminal; and a select circuit having a first input terminal coupled to the output terminal of the first bandgap generator, a second input terminal coupled to the output terminal of the second bandgap generator, and an output terminal coupled to the output terminal of the bandgap circuit.

16. A programmable integrated circuit, comprising:

a programmable logic circuit coupled between a regulated voltage node and a ground terminal;

a bandgap circuit having a bandgap voltage output terminal;

a first operational amplifier having a first input terminal coupled to the bandgap voltage output terminal of the bandgap circuit, a second input terminal coupled to the regulated voltage node, and a pass voltage output terminal; and a pull-up network coupled between a power supply terminal and the regulated voltage node, the pull-up network having a first input terminal coupled to the pass voltage output terminal of the first operational amplifier, and further having a plurality of enable input terminals, wherein enable signals at the enable input terminals control the effective channel width of the pull-up network.

17. The programmable integrated circuit of claim 16, further comprising:

a control circuit having an input terminal coupled to the pass voltage output terminal of the first operational amplifier, and further having a plurality of output terminals coupled to the enable input terminals of the pull-up network.

18. The programmable integrated circuit of claim 17, wherein the control circuit comprises:

a second operational amplifier having a first input terminal coupled to the pass voltage output terminal of the first operational amplifier, a second input terminal coupled to a first reference voltage input terminal, and an output terminal; and a counter having an input terminal coupled to the output terminal of the second operational amplifier, and further having a plurality of output terminals each coupled to a corresponding one of the output terminals of the control circuit.

19. The programmable integrated circuit of claim 18, further comprising:

a delay element coupled between the output terminal of the second operational amplifier and the input terminal of the counter.

20. The programmable integrated circuit of claim 18, wherein the control circuit further comprises:

a third operational amplifier having a first input terminal coupled to a second reference voltage input terminal, a second input terminal coupled to the pass voltage output terminal of the first operational amplifier, and an output terminal coupled to a second input terminal of the counter.

* * * * *